US005611529A

United States Patent [19]

Richarz et al.

[11] Patent Number: 5,611,529

[45] Date of Patent: Mar. 18, 1997

[54] DEVICE FOR STREAM FEEDING SHEETS ONTO A STACK

[75] Inventors: Hans-Peter Richarz; Dirk Lünenschloss, both of Langenfeld; Bernd Wüstenhagen, Wesel, all of Germany

[73] Assignee: VITS Maschinenbau GmbH, Langenfeld, Germany

[21] Appl. No.: 530,201

[22] PCT Filed: Apr. 13, 1994

[86] PCT No.: PCT/EP94/01134

§ 371 Date: Sep. 15, 1995

§ 102(e) Date: Sep. 15, 1995

[87] PCT Pub. No.: WO94/25384

PCT Pub. Date: Nov. 10, 1994

[30] Foreign Application Priority Data

May 5, 1993 [DE] Germany ..... 43 14 756.9
May 5, 1993 [DE] Germany ..... 9306740 U

[51] Int. Cl.[6] ..... B65H 29/68

[52] U.S. Cl. ..... 271/183; 271/197

[58] Field of Search ..... 271/182, 183, 271/184, 194, 195, 197, 211

[56] References Cited

U.S. PATENT DOCUMENTS

| | | | |
|---|---|---|---|
| 3,224,761 | 12/1965 | Meyer-Jagenberg | 271/195 |
| 3,503,607 | 3/1970 | Gluskin | 271/195 |
| 3,698,709 | 10/1972 | Heal et al. | 271/183 |
| 3,941,374 | 3/1976 | Vits | 271/183 |
| 4,157,177 | 6/1979 | Strecker | 271/197 |
| 4,221,377 | 9/1980 | Bodewein et al. | 271/183 |
| 4,247,094 | 1/1981 | Vits | 271/183 |
| 5,186,450 | 2/1993 | Vits | 271/197 |
| 5,265,863 | 11/1993 | Becker | 271/183 |

FOREIGN PATENT DOCUMENTS

| | | |
|---|---|---|
| 2348320C3 | 3/1975 | Germany . |
| 2532880C3 | 1/1977 | Germany . |
| 2601081A1 | 7/1977 | Germany . |
| 2615864C3 | 10/1977 | Germany . |
| 2841658C2 | 1/1980 | Germany . |
| 3812685A1 | 10/1989 | Germany . |
| 4119511A1 | 12/1992 | Germany . |

*Primary Examiner*—H. Grant Skaggs
*Attorney, Agent, or Firm*—Herbert Dubno

[57] ABSTRACT

A device for stream feeding of sheet onto a stack including first and second conveyors spaced apart along a conveying path of the sheets, a deflector mounted between the conveyors and a braking system reducing a transport speed of the sheets and providing loading the sheets onto a stack.

11 Claims, 4 Drawing Sheets

DEVICE FOR STREAM FEEDING SHEETS ONTO A STACK

CROSS REFERENCE TO RELATED APPLICATIONS

This is a National Phase Application of PCT/EP94/01134 filed 13 Apr. 1994 and based, in turn, on German Application G 93 06 7402 filed 5 May 1993 under the International Convention.

FIELD OF THE INVENTION

The invention relates to a device for stream feeding of sheets onto a stack where the successively delivered sheets are conveyed with the first and the second conveying direction over the stacking device.

BACKGROUND OF THE INVENTION

Devices for stream feeding of sheets onto a stack are usually used downstream of a crosscutter, but it also is possible to use such devices downstream of printing presses.

A device by means of which sheets of different lengths can be deposited is known from DE-OS 38 12 685. In this braking mechanism for sheet deposition, successively arranged sheets, or layers of sheets are fed with a delivery speed to a slower running conveyor, so that the sheets overlap. This slightly scaled layer stream runs through a braking gap, which reinforces the scale arrangement. The braking gap is formed by a braking member slidable in travel direction above and below the conveyor.

The drawback of this device is that in the braking gap due to the pressure applied over the very short span the danger of impressions on the sheets is especially high. Particularly, in the case of sensitive materials, e.g. labels, such impressions can hardly be avoided. In addition, the conveyors themselves with their lower and upper conveyor belts can easily lead to impressions. Besides, braking mechanisms with conveyor belts have a high manufacturing cost and, due to their large extension in the travel direction, also have big space requirements.

A further device with conveyor belts is known from the DE-OS 41 19 511. This device is equipped with clamping elements for braking the sheets, which again leads to impressions, particularly in the case of sensitive materials.

From German Patents 23 48 320, 25 32 880, 26 15 864 and 28 41 658 devices for the stream feeding of sheets onto a stack are known, wherein suspension rails are used for conveying the sheets.

By means of suspension rails the sheets are transported on an air cushion without the danger of impressions. Also in their braking devices, suction rollers or suction rails there is substantially less danger of impressions when compared to a braking gap or clamping elements. These devices have a more compact construction than the devices having conveyor belts. However, they have the disadvantage that they can be used only for sheets of the same length.

In the species-establishing device described in German Patent 28 41 658 the braking device is built as a swingable suction rail, whereby the drive of a deflection device is synchronized with the drive of the suction rail. This device is suitable only for long sheets having the same length. An eventual refitting of the drives for a changed sheet length is difficult, if not downright impossible. Besides with these drives it is not possible to quickly revert the suction rail to its initial position, in order to brake short sheets delivered at high speed.

OBJECTS OF THE INVENTION

It is the object of the invention to provide a device for stream feeding sheets onto a stack overcoming drawbacks of the prior art in which sheets of various lengths, even of sensitive material, can be deposited without impressions.

It is still another object to provide the device according to the invention.

Yet another object of the invention is to provide the device having a compact dimension.

With a device according to the invention it is possible to stream feed and stack sheets of different length. Thereby the sheets length can range between a minimal sheet length $l_{min}$ and a maximal sheet length $l_{max}$.

SUMMARY OF THE INVENTION

By arranging according to the invention the braking belts of the braking device in the rear area of the stacking device, i.e. in the area above the leading edge of the deposited sheets, the braking device of the invention acts upon the leading edge of the sheets. The delivered sheets are conveyed at their leading edges by the suspension rails of the second conveying device up to the braking belts, are then braked and deposited by the same.

As soon as the trailing edge of a sheet reaches the deflection device, it is deflected downwards from conveying plane. Subsequently the sheet is braked by the braking device, so that the leading edge of the following sheet is moved over the trailing edge of the first sheet. The sheets arranged in this scaled manner are deposited on the stacking device.

The braking belts are equipped with means, such as a surface with high friction resistance, which cause the leading edges of the sheets to adhere. Besides they are guided over a certain span in the conveying plane. Due to the adherence of the sheets to the braking belts and to the large braking stretch the sheets can be braked without the danger of impressions, can be tightly scaled and deposited with great stacking accuracy due to the guidance of the sheets above the stack.

A variable sheet length is also achieved due to the fact that the braking belts are slidably arranged between the suspension rails of the second conveying device, namely in the rear area of the stacking device, which extends from an area above the leading edge of the deposited sheets of minimal sheet length $l_{min}$ up to the leading edge of the deposited sheets of maximal sheet length $l_{max}$. Since the suspension rails run over the entire stacking device, the leading edges of the sheets can be conveyed through the suspension rails up to the braking belts at any position of the braking belts corresponding to the length of the sheets.

The braking device according to the invention with braking belts which are slidably arranged in the rear area of the stacking device between the suspension rails of the second conveying device provides the deposition of sheets of variable sheet length without the danger of impressions. In addition, it leads to a very compact construction of the device according to the invention.

Due to the common driving shaft according to claim 2, the braking belts require only one drive. Besides a common driving shaft makes possible a common slidability of the braking belts with little manufacturing effort and little refitting effort. For instance, the braking belts can be guided over rollers. A drive roller is fastened to the driving shaft and the driving shaft is connected in the travel direction with a slidable support.

Due to the fact that the braking belts are designed as suction belts according to claim 3, the sheets adhere safely to the braking belts without danger of impressions.

The suspension rails of the first conveyor device according to the invention provide a transport of the sheets on an air cushion and the conveyor disks with pressure rollers. The latter provides an acceleration of the sheets, so that between the sheets a space necessary for staggering results. Thereby the conveyor disks, pressure rollers and braking belts are arranged so that the distance between the conveyor disks and the braking belts arranged in the foremost position is slightly greater than the minimal sheet length $l_{min}$ and the distance between the conveyor disks and the stacking device is slightly greater than the length of the braking belts in travel direction. The arrangement of the conveyor disks between the suspension rails leads to a more compact construction than in the arrangement of a suction conveyor roller downstream of the suspension rails as described in German Patent 28 41 658.

The cams at the rear end of the suspension rails lead to a slightly sinusoidal course of the sheets across the travel direction. Thereby the sheets are stabilized, particularly the ones made of a light material or the like, e.g. labels which due to an imprint have very little inherent rigidity. This stabilization of the sheets, primarily of their leading edges makes possible a problem-free sheet guidance, even while the leading edges leave the conveyor rollers and move to the upper suspension rails of the second conveyor device.

A deflection device of a device of the invention with a brush roller and a guide table has a simple construction. With the aid of the brush roller the trailing edges of the sheets are deflected to the guide table and during the braking of the sheets are guided over the table towards the stacking device. Especially in its front area the guide table can have means for holding the trailing edges of the sheets on the guide table. This means, for instance a slightly rough surface, should have only a slight adhesive effect, so that they do not impede the guidance of the trailing edges over the guide table. The brush roller is connected with a separate variable-speed motor, e.g. a servomotor. As a result, sheets of various length can be deflected. Thereby for the deflection of the sheets the brush roller is accelerated to a conveying speed in a timing rhythm corresponding to various sheet lengths, subsequently braked and then again accelerated for the deflection of the next sheet.

If the length of the guide table corresponds approximately to the length of the braking belts in travel direction, the sheets are braked as soon as their trailing edges are deflected downwards.

The brush roller according to another feature of the invention has a hollow roller made of carbon fibers. As a result, the brush roller has a small moment of inertia and can be accelerated to various speeds and braked without problems.

Due to the straps of the guide comb when the brush bristles are raised the leading edges of the sheets are safely lead to the suspension rails of the second conveyor device. As a result possible disturbances, e.g. due to sheets pushed against the suspension rails, are safely avoided.

According to the invention the guide table is designed as an injector table, whereby through the injector pipe an air flow is produced, leading to slight suction effect through the suction opening. As a result the trailing edges of the sheets which have just been deflected downwards are held on the guide table. This is particularly advantageous in the case of sheets made of a light material.

The construction of the guide table with an upper and lower plate and an injector pipe arranged therebetween provides a simple construction of the guide table designed as an injector table. The air flow produced by the air exiting in travel direction from the openings of the injector pipe results not only in the slight suction effect through the suction openings, but also in a blowing effect through the blow slot. The air coming from the blow slot flows in travel direction over the stacking table and simplifies the alignment of the sheets falling down on the stack. With this simple construction of the guide table the stream feeding of the sheets onto the stack can be improved.

A device according to the invention is particularly suited to constitute a constructive unit with a crosscutter. Thereby the distance between the blades of the crosscutter and the conveyor disks of the device is slightly smaller than the minimal sheet length $l_{min}$.

The above and other features, objects and advantages will become more readily apparent from the specific description, references being made to the following drawing, in which.

SPECIFIC DESCRIPTION

A device for stream feeding sheets 1 onto a stack forms together with a crosscutter a constructive unit wherein a feeding device, the crosscutter and the device of the invention are arranged one after the other in the direction of travel. The arrows A indicate the travel direction and the vertical position of the conveying plane of sheets 1.

Figure 1:
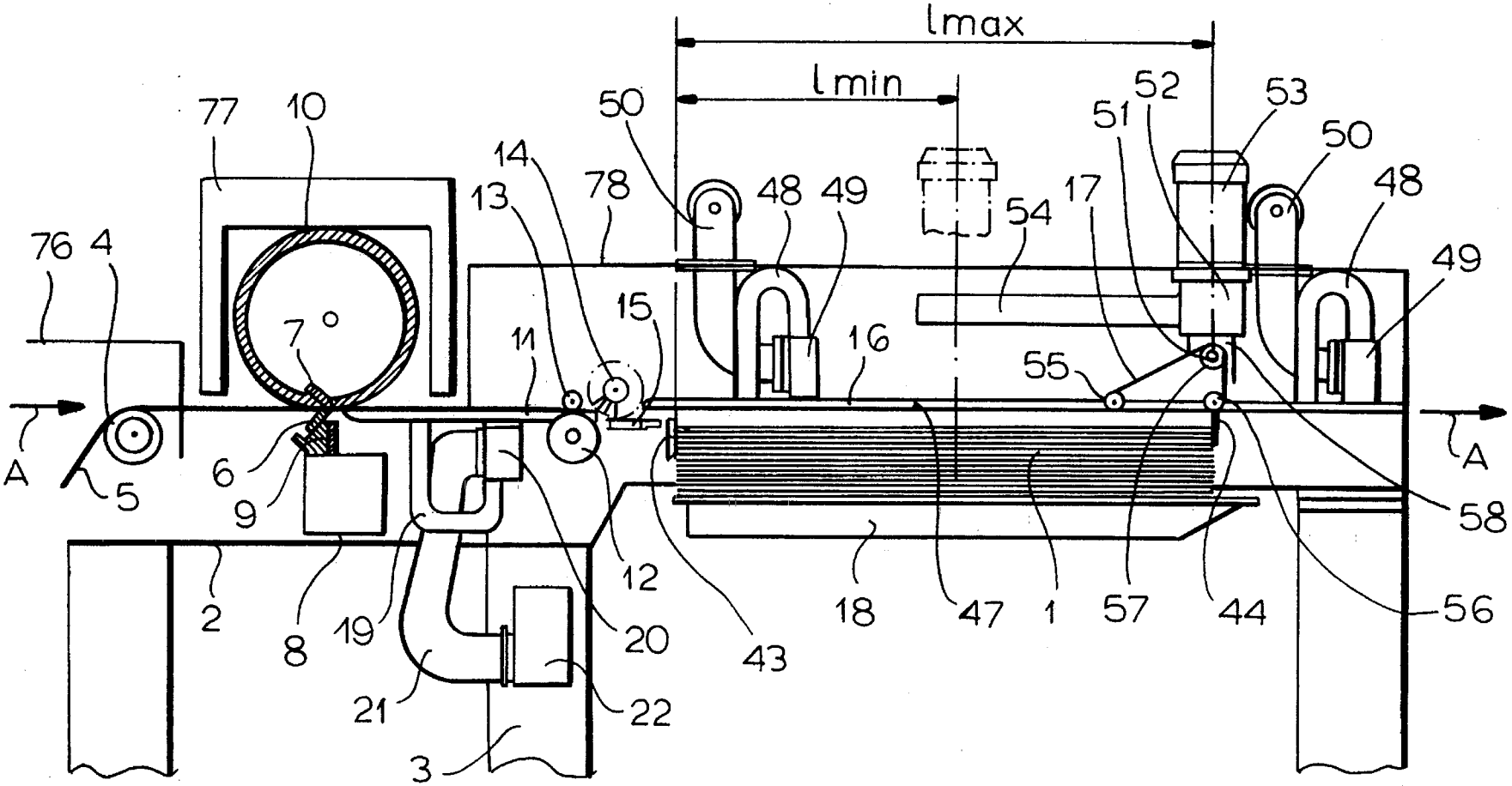
FIG. 1 is a device according to the invention in a constructive unit with a crosscutter.

The constructive unit is supported by a frame 2 with supports, e.g. square pipes 3. FIG. 1 shows the last guide roller 4 of the feeding device for the incoming web 5. In addition to further guide rollers the feeding device can have a longitudinal cutter and a measuring roller, e.g. for establishing the web tension.

The crosscutter has a lower stationary blade 6 and an upper rotating blade 7. The lower blade 6 is arranged on rail 9 fastened to a support 8 at an acute angle with respect to the travel direction and extends over the width of the unit. The cutting edge of the upper blade 7 arranged in a blade roller 10 has a slightly spiralling course, so that during the rotation of the blade roller 10, together with the lower blade 6 it separates the web 4 into sheets 1 like a hobbing cutter.

A device for stream feeding of sheets onto a stack has a first conveyor device with suspension rails 11, conveyor disks 12 and pressure rollers 13, a deflection device with a brush roller 14 and a guide table 15, a second conveyor device with suspension rails 16, a braking device with braking belts 17 and a stacking device with a stacking table 18. Thereby the first conveyor device and the deflection device are arranged one after the other in travel direction upstream of the stacking device.

The suspension rails 11 of the first conveyor device are located beneath the conveying plane, whereby their upper edges are at a short distance from the conveying plane. They extend starting from the lower blade 6 parallel to the travel direction until shortly before the brush roller 14 of the deflection device and are arranged transversely slidable with respect to the travel direction. Their front ends, i.e. their ends pointing against the travel direction towards the crosscutter are bevelled so that their upper edges project closely towards the lower blade 6. The suspension rails 11 are connected via flexible plastic pipes 19, a common supply channel 20, an air duct 21 and a further air channel 22 to a distributor not shown in the drawing, which in turn is connected to a fan also not shown in the drawing.

Figure 2:
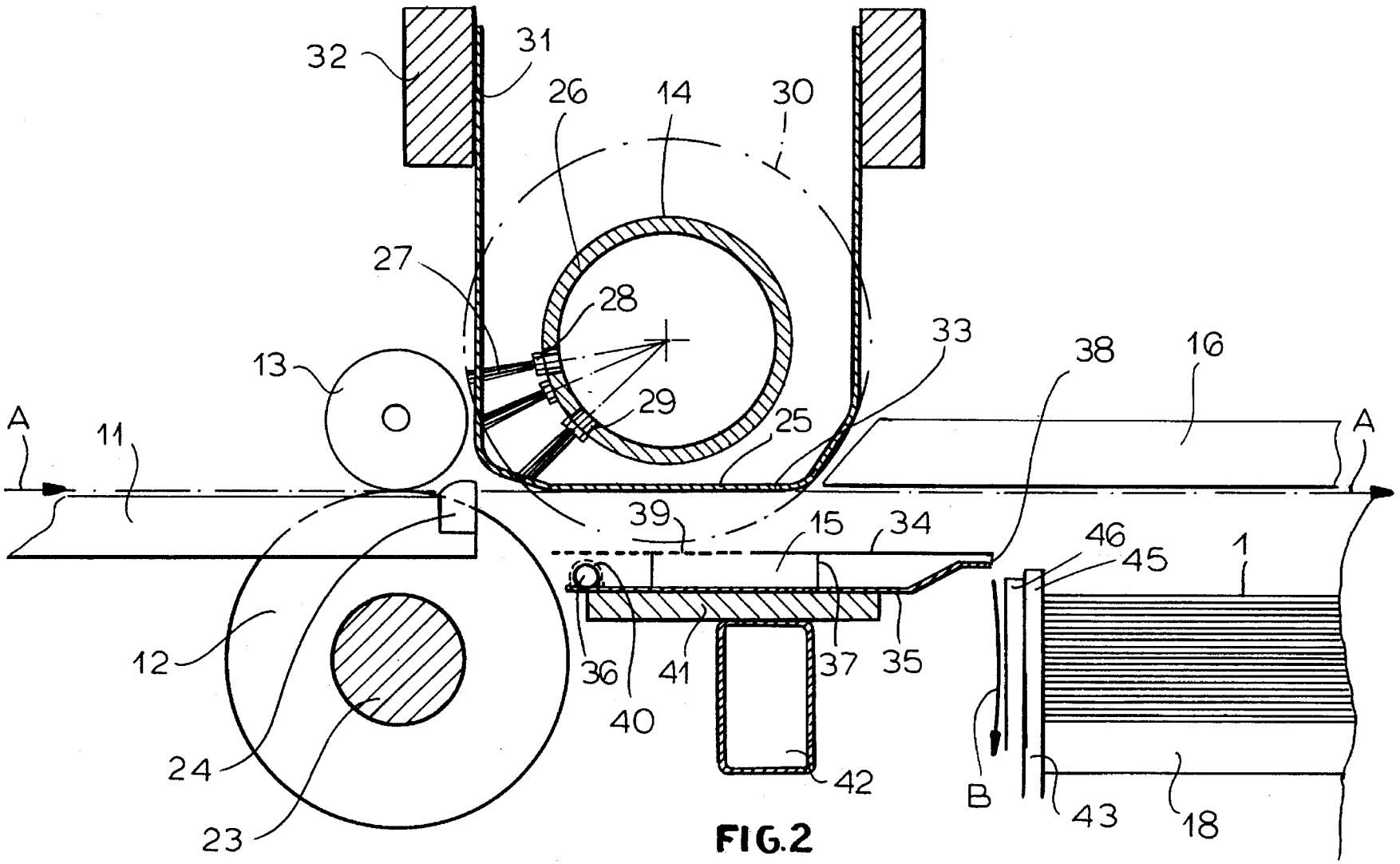
FIG. 2 is a section of the device of the invention with a part of the first conveyor device with the deflection device, with a part of each the second conveyor device and the stacking device.

The conveyor disks 12 are located between the suspension rails 11 in the area of the rear ends of the suspension rails 11. They are arranged to slide transversely to the travel direction on a common shaft 23 connected to a drive as seen in FIG. 2. The conveyor disks 12 project by 1 to 2 mm over the upper edges of the suspension rails 11.

The pressure rollers 13, so-called trolleys, are located vertically above the conveyor disks 12. Each is swingingly supported transversely to the travel direction and are pneumatically pressed onto the conveyor disks 12. Their diameter equals approximately a third of the diameter of the conveyor disks 12. Conveyor disks 12 and pressure rollers 13 are also arranged slidably across the travel direction.

At the front ends of the suspension rails 11, in travel direction behind the axes and thereby behind the contact line of conveyor disks 12 and pressure rollers 13 height-adjustable narrow cams 24 (FIG. 2) are fastened on one side of each suspension rail 11. A cam 24 consists for instance of a narrow square plate, whose upper side is bevelled, whereby the point formed due to the bevelling is rounded. The cams are mounted so that their points are oriented in the travel direction and project over the upper edge of the suspension rails 11. They can have an oblong hole and can be fastened by screws to the suspension rails 11. Over the travel width the cams 24 form projections over the conveying plane, arranged at regular intervals. The projections lead to a slightly sinusoidal course of the sheets 1 across the travel direction.

The brush roller 14 with a guide comb 25 and the guide table 15 are arranged immediately after the pressure rollers 13 and the conveyor disks 12.

The brush roller 14 arranged above the conveying plane has a hollow roller 26 made of carbon fibers, on which at an axial interval of 5 to 20 mm, for instance of 10 mm, one to three bristle bundles 27, for instance a row of three bristle bundles 27, are fastened. The bristle bundles 27 are arranged at the circumference of the hollow roller 26, radially in a corresponding area at an angle of 10° to 60°, for instance approximately 40°. The bristle bundles 27 are fitted into small steel cylinders 28 having an outer threading. The steel cylinders 28 are screwed into corresponding steel cylinders 29 with an inner threading, embedded in the hollow roller 26.

The brush roller 14 is arranged so that a lower segment of a path curve 30 of the ends of bristle bundles 27 indicated in a dash-dot line runs in travel direction behind the cams 24 mounted on the ends of the of the suspension rails 11 beneath the conveyor plane, and projects closely towards the guide table 15 arranged also beneath the conveying plane at a distance of approximately 30 to 70 mm, e.g. 50 mm, from the conveying plane. The brush roller 14 is connected to a servomotor.

The guide comb 25 has narrow straps 2 to 10 mm, for instance 5 mm, wide which are arranged in the interstices between the rows of bristle bundles 27 of the brush roller 14. The straps are bent to an approximate U-shape, whereby their flanks 31 are fastened above the brush roller 14 on supports 32, e.g. flat irons extending over the width of the constructive unit, arranged transversely to the travel direction in such a manner that the horizontally running bottoms 33 of the Us upwardly limit the conveying plane. The bottoms 33 of the straps project at their frontal rounded ends close to the cams 24, and with their rear bevelled edge come close to the suspension rails 16 of the second conveyor device, whereby the bevel of the rear ends runs tangentially to the path curve 30 of the ends of bristle bundles 27.

The guide table 15 of the deflection device extends over the width of the constructive unit and in travel direction from the conveyor disks 12 to the stacking table 18. It is built as an injector table and has at the above-indicated distance a plate 34 running parallelly to the conveying plane, a lower plate 35 arranged underneath it and an injector pipe 36. The lower plate 35 runs parallelly to the upper plate 34 until it comes close to the stacking table 18. The distance between the upper plate 34 and the lower plate 35 is kept constant in this area by spacers 37. In the vicinity of the stacking table 18 the lower plate 35 is bent upwards over its entire width towards the upper plate 34 and for a small portion runs at a short distance from the upper plate 34. Thereby a blow slot 38 is formed, whose blowing direction points in travel direction over the stacking table 18.

In the frontal area of the guide table 15 the upper plate 34 has suction openings 39, for instance rows of holes extending over the conveying width. These rows of holes end underneath the rear area of the guide comb 25.

At the end of the guide table 15 facing the conveyor rollers 12 an injector pipe 36 transverse to the travel direction is fastened to the lower plate 35, between the upper and lower plates 34, 35. It has at its rear side, i.e. the side pointing in travel direction, an axially parallel row of openings 40, e.g. bores, and is connected to a source of compressed air.

The lower plate 35 is fastened via a plate 41 to a support 42 arranged transversely to the travel direction. The guide table 15 can be swung downwards according to arrow B via a swinging device not shown in the drawing.

The stacking table 18 arranged beyond the guide table 15 is attached to commonly used lifting and lowering devices and is provided at its frontal end with a rear-edge stop 43 and at its rear end with a frontal-edge stop 44 (FIG. 1). The rear-edge stop 43 and the frontal-edge stop 44 have stationary and movable parts. FIG. 2 shows schematically a stationary plate 45 and a movable plate 46, also called a jolter, of the rear-edge stop 43. The frontal-edge stop 44 is arranged slidable in travel direction, whereby the maximal distance between the rear-edge stop 43 and the frontal-edge stop 44 corresponds to the maximal sheet length $l_{max}$ and the corresponding minimal distance corresponds to the minimal sheet length $l_{min}$.

The suspension rails 16 of the second conveyor device are located above the conveying plane, whereby their lower edges are at a short distance from the conveying plane. They extend parallelly to the conveying plane starting from the guide comb 25 over the rear portion of the guide table 15, over the stacking table 18 and beyond the stacking table 18. They also are arranged transversely slidable with respect to the travel direction. The frontal ends of the suspension rails 16 are bevelled to correspond with the shape of the straps of the guide comb 25, so that their lower edges come close to the path curve 30 of the ends of the bristle bundles 27.

In the area outside of the stacking table 18 the suspension rails 16 no longer have nozzle openings. Approximately in the middle of the remaining area with nozzle openings the suspension rails 16 are divided into a frontal and a rear segment by way of separating walls 47. In each segment the suspension rails 16 are connected via flexible plastic pipes 48, a common air channel 49 and an air duct 50 to the distributor to which also the suspension rails 11 of the first conveyor device are connected. Thereby the plastic pipes 48, the common air channel 49 and the air duct 50 of the rear segment are arranged outside the stacking table 18.

The braking device has in addition to the braking belts 17 a common driving shaft 51 arranged transversely to the travel direction, a support 52, a driving motor 53 and two rails 54. The braking belts 17 are arranged in some of the intermediate spaces between the suspension rails 16, for instance in each second to fifth intermediate space. The braking belts arranged respectively between two suspension rails 16 are each guided about three rollers 55, 56 and 57 with axes arranged transversely to the travel direction. The rollers 55 56 each are arranged in succession in the travel direction, whereby their horizontal position is laid out so that the underside of braking belts 17 represents the upper limit of the conveying plane in the segments between the rollers 55, 56.

The third rollers 57 are located above the suspension rails 16. They are built as driving rollers and are mounted on the common driving shaft 51. The driving motor 53 which can be operated at variable speeds is arranged on the support 52, e.g. a square pipe also arranged transversely to the travel direction and is connected with the driving shaft 51 via bevel gear 58 projecting through an opening into the support 52.

The support 52 is guided at its lateral ends on the two rails 54 running parallelly to the travel direction and is connected to a drive not shown in the drawing, e.g. a manually actuated spindle drive. The rails 54 extend on the lateral edges of the constructive unit along the stacking table 18.

Figure 3:
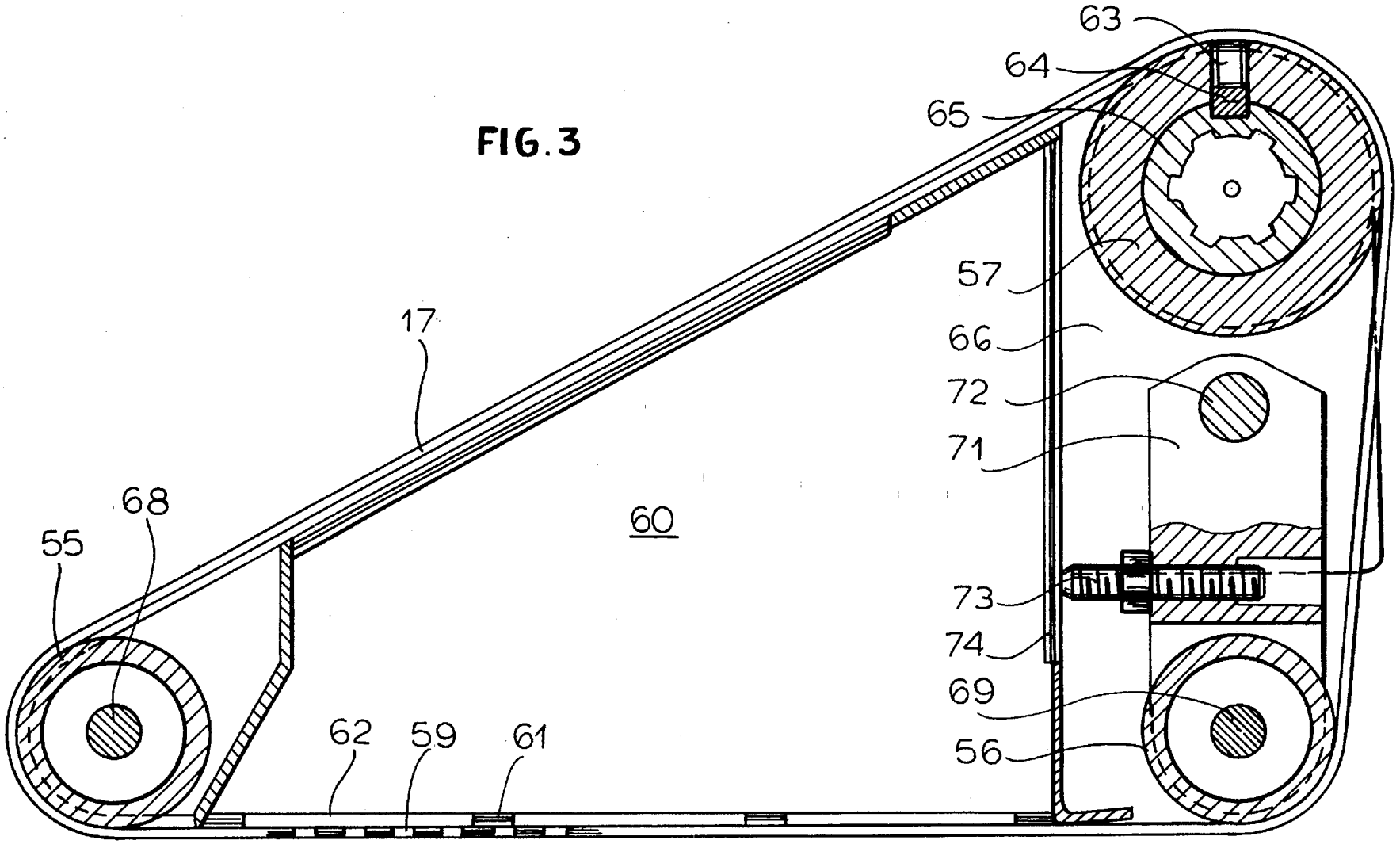
FIG. 3 is a vertical section of the braking device in travel direction.

The braking belts 17 are designed as suction belts. They have uniformly arranged openings 59 (FIG. 3), whereby the free surface through the surface of the openings 59 equals one fourth to a half of the surface of the braking belts 17. The openings 59 for instance are round and have a diameter of e.g. 5 mm. The braking belts 17 have an adhesive, e.g. gummed surface. Their width equals for instance 25 mm.

The spaces inside the endless braking belts 17 guided about the rollers 55, 56, 57 are occupied to a large extent by the suction boxes 60, whose width corresponds approximately to the width of the braking belts 17. The suction boxes 60 are connected via connection pieces arranged above the suspension rails 16, flexible plastic pipes, a common suction channel and a suction duct to a further fan also not shown in the drawing.

The suction boxes 60 are arranged so that the braking belts 17 rest against the bottoms 61 of the suction boxes 60 between the rollers 55 and 56. The bottoms 61 have oblong and staggered slots 62. The width of the slots 62 equals for instance 5 mm, their length e.g. 20 mm. The free surface through the slots 62 represents a third to two thirds of the surface of bottom 61.

For the connection with the driving shaft 51 the driving rollers 57 of the braking belts 17 are each corotationally fastened via a screw 63 and a fitted element 64 on a hollow shaft 65 designed as a recessed polygon and arranged on the driving shaft 51. The driving shaft 51 is correspondingly designed as a polyhedron.

The braking device has for each braking belt 17 a mounting 66 which is connected with the rollers 55, 56, 57 and the suction box 60. The mounting 66 is positioned for instance by means of fishplates braced on the support 52.

The hollow roller 65 protrudes on both sides from the roller 57, is surrounded in this area by small hollow cylinders of the mounting 66 and is connected with the same over the bearing 67. The mounting 66 has also two plates running parallelly to the travel direction from the sides of roller 57 to the sides of roller 55, to which the suction box 60 arranged between the plates and a shaft 68 of the roller 55 is fastened. The plates of the mounting 66 can also be designed as lateral plates of the suction box 60.

Figure 4:
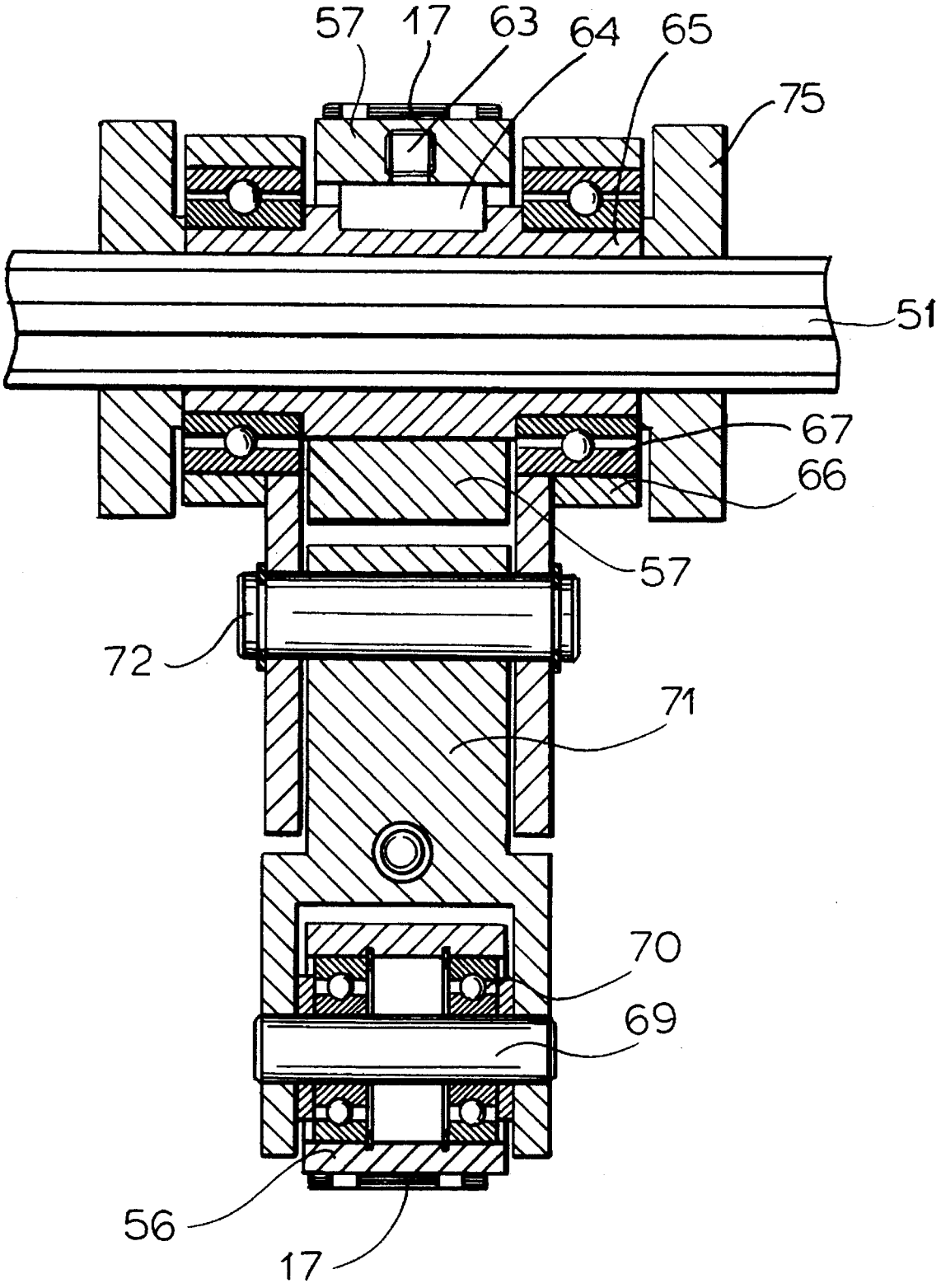
FIG. 4 is a vertical section of the braking device through a braking belt.

A shaft 69 of the of the roller 56, whose bearing 70 can be seen in FIG. 4 is connected with the mounting 66 by a holder 71 arranged underneath the roller 57 between the plates. The holder is arranged on a shaft parallel to shaft 69, fastened to the plates of the mounting 66. Underneath the shaft 72, the holder 71 has a threaded bar 73 perpendicular to the shafts 69, 72, arranged in a threaded bore. The threaded bar 73 is supported outside the holder 71 on a casing wall 75 of the suction box 60. By unscrewing the threaded bar 73 the respective braking belt 17 can be stressed.

The hollow shaft 65 is slidably arranged on the driving shaft 51 and is positioned on the driving shaft 51 by clamping disks 75. Due to this the braking belts 17 are also slidably arranged transversely to the travel direction.

The supports 8, 42 as well as the supply channel 20, the air channel 22 and both air channels 49 extend over the width of the constructive unit and are fastened to the frame 2. They consist for instance of square pipes.

Feeding device, crosscutter and the device according to the invention have each a housing respectively 76, 77, 78, whereby the housing of the crosscutter has a sound-proof casing surrounding the blade roller.

The distance between the lower blade 6 and the conveyor disks 12, i.e. the distance between the cutting edge of the lower blade 6 and the contact line of conveyor disks 12 and pressure rollers 13 is somewhat smaller than the minimal sheet length $l_{min}$.

The distance between the conveyor disks 12 and the braking belts 17 in their foremost position is somewhat bigger than the minimal sheet length $l_{min}$ and the distance between the conveyor disks 12 and the rear-edge stop 43 of the stacking table 18 is slightly bigger than the distance of the two lower rollers 55, 56 of the braking belts 17. Particularly the length of the guide table 15 corresponds to the distance of the two lower rollers 55, 56 of the braking belts 17, i.e. the length of the braking belts 17 in the travel direction. The ratio of the length of the braking belts 17 in the travel direction and the maximal sheet length $l_{max}$ equals 0.04 to 0.3, particularly 0.1 to 0.25. The maximal sheet length lmax can for instance be 1,100 mm, the minimal sheet length $l_{min}$ for instance 580 mm, the conveying width approximately 1,500 mm and the length of the braking belts 17 in the travel direction 200 mm.

In operation the web 4 fed at production speed over the feeding device is cut by the crosscutter to the predetermined sheet length. After the cut, the leading edge of the web is conveyed by the suspension rails 11 of the first conveyor device on an air cushion to the conveyor disks 12 and the pressure rollers 13. Since the distance between the lower blade 6 and the conveyor disks 12 is smaller than the minimal sheet length $l_{min}$, the web 4 is seized by the conveyor disks 12 and the pressure rollers 13 prior to cutting. The conveyor disks 12 are driven with a peripheral speed, further mentioned as conveying speed, which is higher by 1 to 2% than the production speed. Due to this fact the web 4 is tightened before cutting. After cutting the sheet 1 which has just been cut off is accelerated with respect to the web 4, so that a clearance is created with respect to the web 4 and thereby to the following sheet 1.

The leading edge of web 4, or after the cut, the leading edge of sheet 1 which leaves the conveyor rollers 12 and the suspension rails 11 of the first conveyor device is conveyed over the raised bristle bundles 27 of the brush roller 14 along the guide comb 25 to the suspension rails 16 of the second conveyor device and from the suspension rails 16 over the stacking table 18 up to the braking belts 17, whereby also in this case there is an air cushion between the suspension rails 16 and the sheet 1 moved underneath them.

As soon as the trailing edge of the cutoff first sheet 1 leaves the suspension rails 11, it is seized by the bristle bundles 27 of the brush roller 14 accelerated with the aid of a servomotor. The peripheral speed of the brush roller 14 corresponds at this moment to the conveying speed, so that the trailing edge of the first sheet 1 is deflected downwards due to a short contact with the bristle bundle 27 from the conveying plane onto the guide table 15. Subsequently the brush roller 14 is braked again, in order to be accelerated only for the deflection of the following sheet 1, i.e. depending on the respective sheet length which also determines the cutting frequency of the upper blade 7.

The compressed air exiting from the injector pipe 36 generates an air flow between the upper and the lower plates 34, 35 in travel direction and thereby generating a suction effect in the suction openings 39 of the upper plate of the guide table 15, which holds the deflected trailing edge of the first sheet 1 on the guide table 15. As soon as the trailing edge of the first sheet 1 is deflected, its leading edge reaches the braking belts 17 arranged between the upper suspension rails 16. The sheet 1 is braked at braking speed.

The braking belts 17 designed as suction belts run over suction boxes 60, whereby the leading edge of sheets 1 safely adheres to the braking belts 17, without producing impressions on the sheet 1.

When the bristle bundles 27 of the brush roller 14 are raised, the leading edge of the following sheet 1 coming in at conveying speed is conveyed along the guide comb 25 to the suspension rails 16 of the second conveyor device and from there over the stacking table 18 up to the braking belts 17. Since the first sheet 1 is in the meantime transported at braking speed with downwards deflected trailing edge guided over the guide table 15, the leading edge of the second sheet 1 overlaps the trailing edge of the first sheet 1 and ends up in the gap between the suspension rails 16 and the first sheet 1.

As soon as the trailing edge of the second sheet 1 leaves the suspension rails 11, it is also deflected by the bristle bundles 27 of the brush roller 14 onto the guide table 15 which is now free in its initial area. The leading edge of the second sheet 1 also reaches the braking belts 17 as soon as the trailing edge was deflected. The second sheet 1 is also braked at braking speed. Its leading edge adheres to the braking belts 17 in front of the leading edge of the first sheet 1. The first and the second overlapped sheets 1 are transported at braking speed to the rear end of the stacking device. The first sheet 1 is stopped at the front-edge stop 44 of the stacking table 18, is peeled off the following, second sheet 1 by the braking belts 17 and falls then onto the stack. The same applies to the following sheets 1. Through the blow slot 38 air streams into the downfalling sheets 1, whereby the alignment of sheets 1 is simplified.

Since from the braking belts 17 the leading edges of sheets 1 reach the gap between the suspension rails 16 and the preceding braked sheet 1, they are already slightly braked during the deflection of the trailing edges. This way an abrupt transition from the conveying speed to the braking speed is avoided.

The overlapping degree of the sheets 1 is higher the smaller the ratio between the braking speed and the conveying speed is. In order to insure that the degree of overlapping is so high that at the same time at least two sheets 1 are braked at the braking belts 17, the length of the braking belts 17 is adjusted to the maximum sheet length $l_{max}$. Thereby the ratio between the two values is at least double as big as double the desired ratio between the braking speed and the conveying speed. The braking speed equals 2 to 15%, particularly 3 to 10%, of the production speed. Since the conveying speed is only slightly higher than the production speed, these ranges apply also to the ratio of braking speed and conveying speed. The production speed ranges between 100 to 600 m/min.

The air pressure applied to the suspension rails 11, 16 equals approximately 30 to 60 mbar, the air pressure applied to the suction boxes of the braking belts approximately 30 to 65 mbar and the air pressure applied at the injector pipe 36 of the guide table 0.5 to 2 mbar.

For instance sheets of printed paper with a surface weight of 70 g/m$^2$, a sheet length of approximately 1,000 mm and a width of approximately 850 mm can be tightly scaled and deposited with a high stacking accuracy at a production speed of 400 m/min and a braking speed of 16 m/min without danger of impressions. Thereby approximately five sheets 1 are simultaneously braked at the braking belts 17. In order to refit for a another sheet length, the braking belts 17 are brought into a different position on the rails 54 corresponding to another sheet length by moving the support 52.

Therefore with a device according to the invention first of all it is possible to stream feed sheets 1 of various length. Besides the width of sheets 1 can also be varied due to the suspension rails 11, conveyor disks 12, pressure rollers 13, suspension rails 16 and braking belts 17, which are all arranged transversely slidable with respect to the travel direction. Due to the adjustment of the compressed air applied to the suspension rails 11, 16, the suction air applied to the braking belts 17 designed as suction belts or to the various bristle bundles 27 which can be screwed into the hollow roller 26 of the brush roller 14 or to other deflection members, sheets made of the most various materials can be stream fed.

A device according to the invention is particularly suited for stream feeding paper sheets, even when they are made of very thin paper, particularly in the production of labels or security paper. It is also suited for use for packaging material or for foils, e.g. films. Sheets made of a material with a surface weight ranging between 30 g/m$^2$ to 800 g/m$^2$ can be stream fed.

I claim:

1. A device for stream feeding sheets onto a stack, comprising:

first conveying means for transporting in a travel direction an end of a web which is cut transversely to form a succession of sheets and then feeding said sheets in a conveying plane along a path, each of said sheets being formed with a respective leading and trailing end;

second conveying means downstream from and spaced from said first conveying means for further transporting said succession of sheets along said path;

deflecting means along said path and between said first and second conveying means for deflecting the trailing end of a respective sheet below said conveying plane before the trailing end of the respective sheet is received by said second conveying means;

stacking means along said path and under said conveying plane for receiving and piling up said sheets, said second conveying means being provided with a pair of suspension rails extending over said stacking means and spaced apart transversely thereto; and braking means provided on a downstream end of said stacking means extending upwardly therefrom for reducing a speed at which said sheets are guided along said suspension rails, said braking means including a plurality of closed loop braking belts between pairs of suspension rails and slidable along said path and delivering each of said successive sheets onto said stacking means.

2. The device defined in claim 1 wherein said plurality of braking belts have a common driving shaft slidable along said path over said stacking means.

3. The device defined in claim 2 wherein said first conveying means further includes cam means formed at said downstream ends of said pair of rails of the first conveying means and extending slightly above said conveying plane for forming a sinusoidal course of each of said plurality of sheets between said pair of rails.

4. The device defined in claim 1 wherein said plurality of braking belts are suction belts.

5. The device defined in claim 1 wherein said first conveying means includes a respective pair of suspension rails having downstream ends and extending below said conveying plane, a plurality of conveyor discs between said downstream ends, and a respective plurality of pressure rollers juxtaposed with said plurality of conveyor discs and defining said conveying plane therebetween.

6. The device defined in claims 1 wherein said deflecting means includes a brush roller mounted above the conveying plane and rotatable about a roller axis extending transversely said travel direction, and a guide table mounted below said conveying plane and extending along said path up to said stacking means, said guide table and said braking belts having substantially the same length.

7. The device defined in claim 6 wherein said brush roller is hollow and is made of carbon fibers.

8. The device defined in claim 6 wherein said brush roller is provided with a plurality of bristle bundles formed on a periphery of said brush roller and spaced angularly and axially apart, and a plurality of straps of a guide comb on said periphery between said bristle bundles.

9. The device defined in claim 6 wherein said guide table is provided with plurality of suction openings formed close to a downstream end of said guide table, and an injector pipe below said openings and in flow communication therewith, said pipe extending transversely said travel direction.

10. The device defined in claim 9 wherein said guide table is provided with an upper and lower plates forming a blow slot at said downstream end of said guide table pointing at said travel direction, said injector pipe being mounted between said upper and lower plates and being formed with respective openings opening in the travel direction.

11. The device defined in claim 1, further comprising a crosscutter upstream from said first conveying means.

* * * * *